US005228159A

United States Patent [19]

Gurka

[11] Patent Number: 5,228,159

[45] Date of Patent: Jul. 20, 1993

[54] COMBINATION TOOL FOR PAINTERS OR THE LIKE

[76] Inventor: Philip W. Gurka, 142½ Watchung Ave., Upper Montclair, N.J. 07043

[21] Appl. No.: 889,260

[22] Filed: May 28, 1992

[51] Int. Cl.[5] ..... B25F 1/00

[52] U.S. Cl. ..... 7/105; 7/169; 7/149

[58] Field of Search ..... 7/105, 169, 166, 170, 7/143, 146, 147; D8/16, 18, 33, 34, 40, 81, 88, 89, 105; 81/3.4, 3.07, 3.55, 3.57

[56] References Cited

U.S. PATENT DOCUMENTS

| | | | |
|---|---|---|---|
| 376,825 | 1/1888 | Kent | 7/105 |
| 1,890,273 | 12/1932 | Wells | D8/89 |
| 2,006,944 | 7/1935 | Courtney | 81/355 |
| 2,896,910 | 7/1959 | Cooper et al. | 7/166 |
| 3,134,574 | 5/1964 | Reuterfors | 7/166 |
| 4,216,685 | 8/1980 | Taylor | 81/3.55 |
| 4,658,455 | 4/1987 | Skillern | 7/105 |

*Primary Examiner*—Roscoe V. Parker

[57] ABSTRACT

A combination tool comprising a one-piece thin elongated rigid normally flat blank applied with bends, apertures and incisions thereon, providing a body portion on one end in combination with a right angle extension to a straight oblique handle portion on the other end, the front end of said body portion formed with a reverse bend providing a terminal extended hook furnished with integral means to remove plastic lids, be receptive to a container handle and also perform as a hammer-head, the rear-end of said body portion provided with a right angled bend projected in the opposite direction of said terminal extended hook side and precedes an extension furnished with a bend to said oblique handle portion, the concave side of said body portion's rear-end right angled bend, when faced upward also forms a receptive hook for a container handle, said oblique handle portion furnished with a reverse bend to provide a terminal hook on the same side as said body portion's terminal extended hook, said terminal hook formed to hold-fast from various supports for the other individual hooks to be stabilized thereby, said handle portion also provided with dual nail extractor apertures to remove nails, said handle portion further provided with an oblong appendage to remove metal lids, and still further, said handle portion provides for said hammer-head to be a complete hammer to close lids tightly.

1 Claim, 4 Drawing Sheets

COMBINATION TOOL FOR PAINTERS OR THE LIKE

BACKGROUND AND OBJECTS OF THE INVENTION

The invention relates to an improvement over using various tools for painting jobs, such as a screw driver to pry off a plastic lid from a plastic pail and a metal lid from a metal container. In addition, a hammer to remove nails or close lids on containers, also a hooking apparatus to hang the handle of a container.

To pry a plastic lid from a plastic pail is not only an aggravating chore but the fingers of the hands must be used to lift the skirt up and off. This is very detrimental to the fingers and the finger-nails.

It is an object of the improvement to remedy this situation. While the use Of a screw driver is suitable in some cases along with a hammer and a hook apparatus, it is far more expedient, safe and efficient to use my invention.

It is an object of my invention to provide one tool to assist painters to do their job.

Another object is to eliminate aggravation.

A further object is to provide a combination tool to have substantial strength and weight to be used as a hammer.

A still further object is to save the fingers and protect against broken finger-nails.

Another object is to save space.

A still further object is to provide a safe and efficient way to remove plastic lids from plastic pails and metal lids from metal containers.

Another object is to employ hooks compatible in various locations.

A further object of the present invention is to provide a combination tool of the character described which is inherently attractive and ornamental in appearance and, being in one piece, which is relatively simple, easy and economical to produce.

The foregoing and other advantages and superiorities of the combination tool of the present invention will become more readily comprehensible by the accompanying drawings and description following. It is understood, however, that the embodiment is shown by way of illustration only to make the principles and practice of the invention more readily comprehensible, and without any intent of limiting the invention to the specific details shown.

In the drawings:

DETAILED DESCRIPTION

Figure 1:
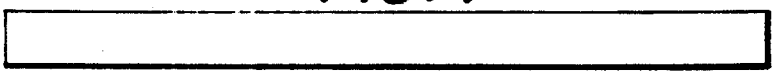
FIG. 1 is a plan view of the blank of the present invention.
Figure 2:
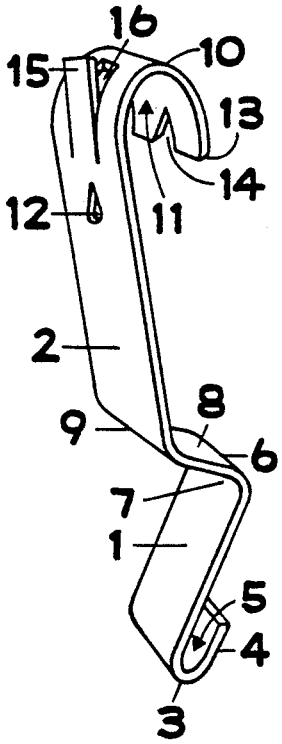
FIG. 2 is a perspective view of the blank of FIG. 1 after being completely formed.

Referring to FIG. 2 it will readily be seen that the combination tool is the result of bends, apertures and incisions having been applied to the blank of FIG. 1. The combination tool is formed from thin rigid material, stiff enough to retain its normal shape during and after performance and is of such length as to form two principle portions, namely; a relatively straight body 1 portion on one end connected by a right angled extension to a relatively straight oblique handle 2 portion on the other end in an extended direction from said body portion.

The front end of said body portion formed with a reverse bend providing a terminal extended hook, furnished with integral means to engage the skirt of a plastic lid to facilitate lid removal from a plastic pail, also to receive the handle of a container thereon and further to perform as a hammer-head.

The rear-end of said body portion provided with a right angled bend projected in the opposite direction of said body portion's terminal extended hook side and precedes an extension provided with a bend to said oblique handle portion.

The concave side of said body portion's rear-end right angled bend, when faced upward, also forms a hook that is receptive fôr the handle of a container there-on.

The handle portion formed with a reverse bend providing a terminal hook on the same side as the terminal extended hook of said body portion, said terminal hook performs as a hold-fast from various supports to stabilize the other individual hooks. The handle portion also provides dual nail extractor apertures to remove nails. The handle portion is further provided with an oblong appendage to remove metal lids from metal containers. Said handle portion also provides for the hammer-head to perform as a complete hammer to close lids tightly on containers.

Essentially, my invention involves firstly, a lid remover for a plastic lid attached to a plastic pail. The plastic lid formed with a rim 22 situated above the main surface 23 of the lid and furnished with an interior fitted coverture 24 assembled with an annular washer 25 atop, and a locking member 26 located on the inside wall of the skirt 17 to engage the rim 27 of the pail 28, clearly indicated in FIG. 5. The outermost sidewall of said rim 22 comprised of a descending outwardly flared skirt 17 that provides a gap 18 therebetween said skirt 17 and the pail 28. Said skirt applied with a series of apertures around the circumference, visibly indicated at 19, 20 and 21 in FIGS. 3 and 4 respectfully.

Figure 10:
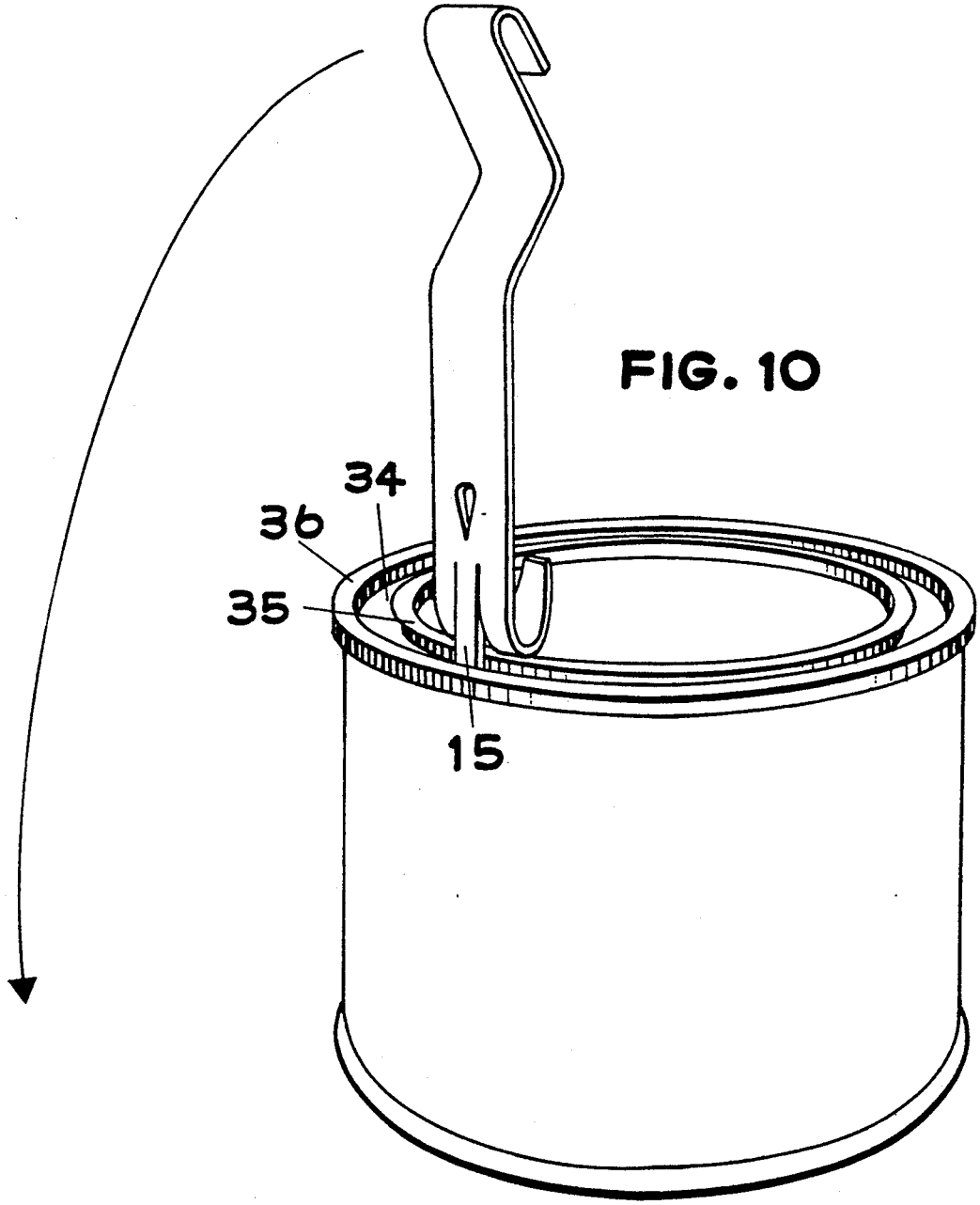
FIG. 10 is a perspective view of this invention positioned to remove a metal lid from a metal container.

Secondly, my invention involves a lid remover for a metal lid attached to a metal container provided with a gap 34 therebetween the rim 35 of the lid and the rim 36 of the container, said gap provides the necessary space by which the lid can be removed, clearly indicated in FIG. 10.

Figure 3:
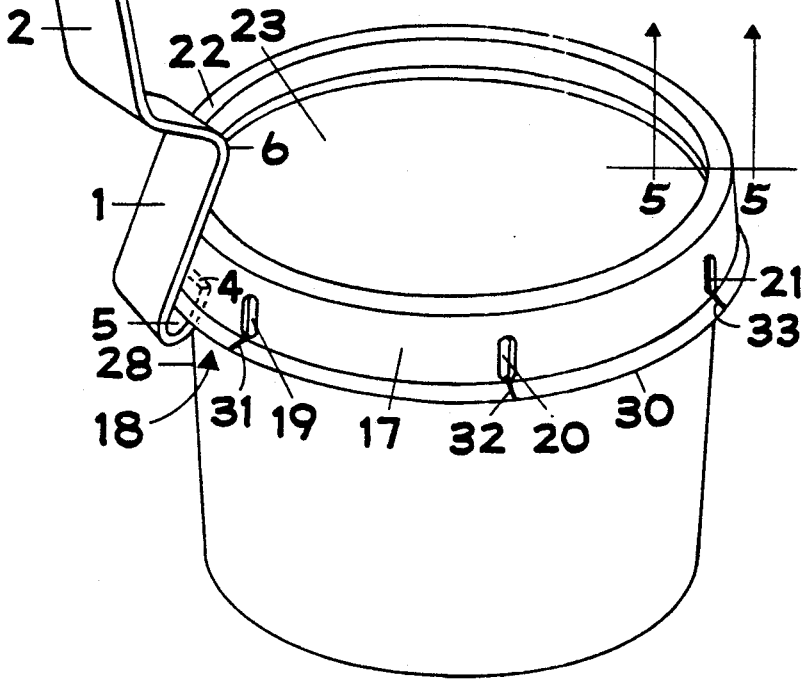
FIG. 3 is a perspective view of the initial phase of removing a plastic lid from a plastic pail.
Figure 4:
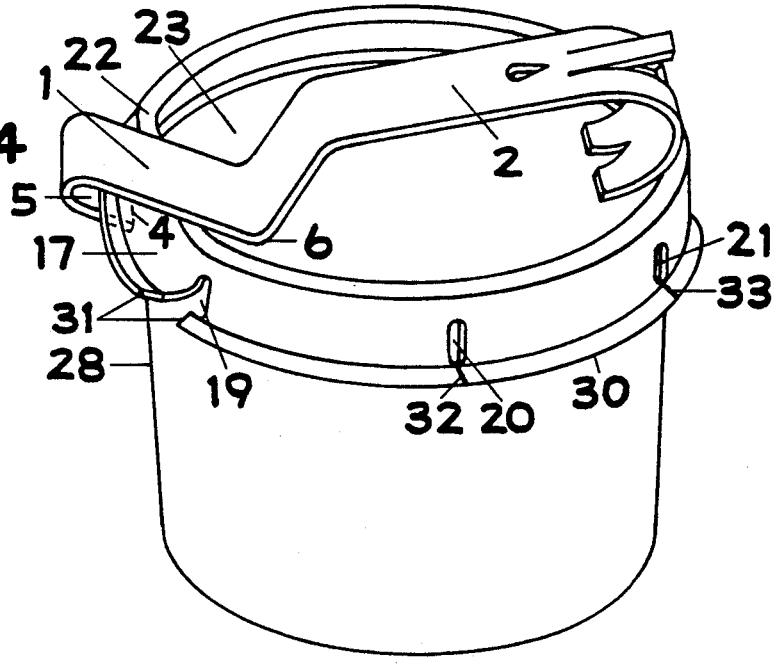
FIG. 4 is a perspective view of the completed performance of the initial phase of FIG. 3.
Figure 5:
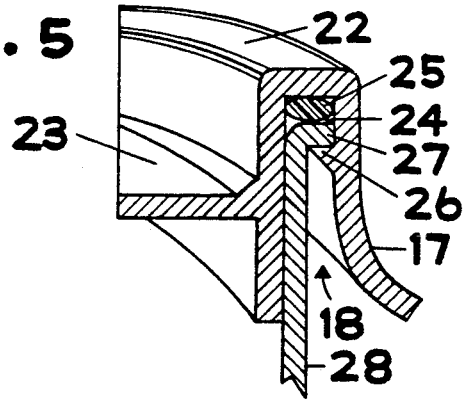
FIG. 5 is a sectional view of the coverture engaged in sealed position, taken along line 5—5 of FIG. 3
Figure 11:
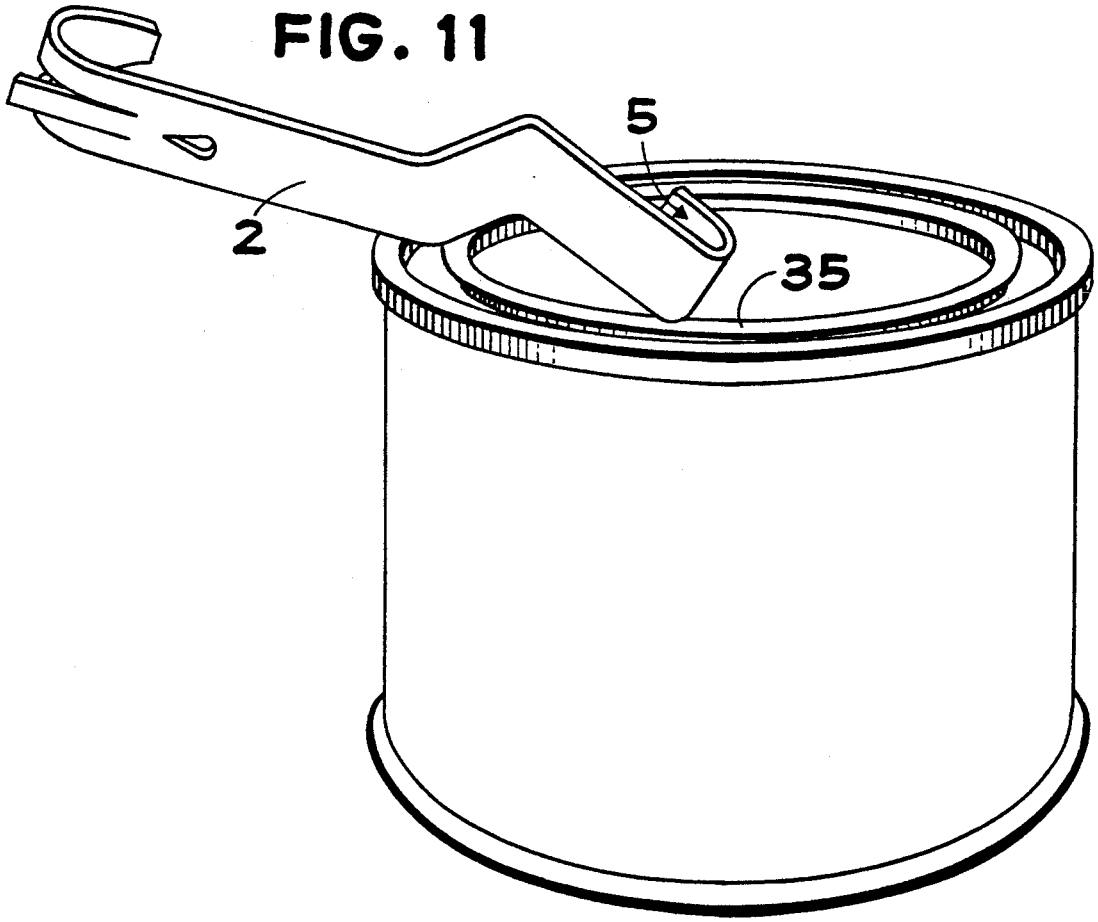
FIG. 11 is a perspective view of this invention positioned to hammer a metal lid closed.

Thirdly, my invention involves hooks of differently gapped widths, furnishing a choice for position placement. The wider hook 11 normally employed as a hold-fast from various supports, such as the rung 37 of a ladder while the terminal extended hook 5 normally is receptive to the handle 29 of a container as clearly indicated in FIG. 7. Said hook 5 also is receptive to a plastic skirt 17 to facilitate removal of a plastic lid from a plastic pail as indicated in FIGS. 3 and 4 respectfully. Further, said hook 5 also performs as a hammer-head as indicated in FIG. 11. The concave side of the body portion's rear-end right angled bend 6, when faced upwardly on the top horizontal step 40 of a step-ladder forms a hook 7 to receive the handle of a container there-on, clearly indicated in FIG. 9

Lastly, my invention involves dual nail extractor apertures 12 and 14 as indicated in FIG. 2 for nail removal from areas prior to painting.

The combination tool of lid removers, hooks, nail extractors and a hammer, comprises a one-piece elongated normally flat rigid strip, formed with bends, apertures and incisions, providing two principle portions as indicated in FIG. 2, namely; a relatively straight body 1 portion on one end in combination with a preferably right angled extension to a relatively straight oblique handle 2 portion on the other end in an extended direction from said body portion.

The front end of said body portion formed with a reverse bend 3 providing a relatively straight terminal extension 4 proceeding in the same general direction from said reverse bend as said body portion but shorter in length and in conjunction with the adjacent said body portion forms a terminal extended hook 5 to remove plastic lids from plastic pails as indicated in FIG. 3, and 4. Said hook also providing integral means for the handle 29 of a container to hang therefrom, clearly visible in FIG. 7 and as a hammer-head as indicated in FIG. 11. The rear-end of said body portion provided with a right angled bend 6 projected in the opposite direction of said body portion's terminal extended hook side and precedes an extension 8 provided with a bend 9 to said oblique handle portion. The concave side of said body portion's rear-end right angled bend, when faced upward, forms a hook 7 to receive the handle of a container thereon as indicated in FIG. 9.

Figure 7:
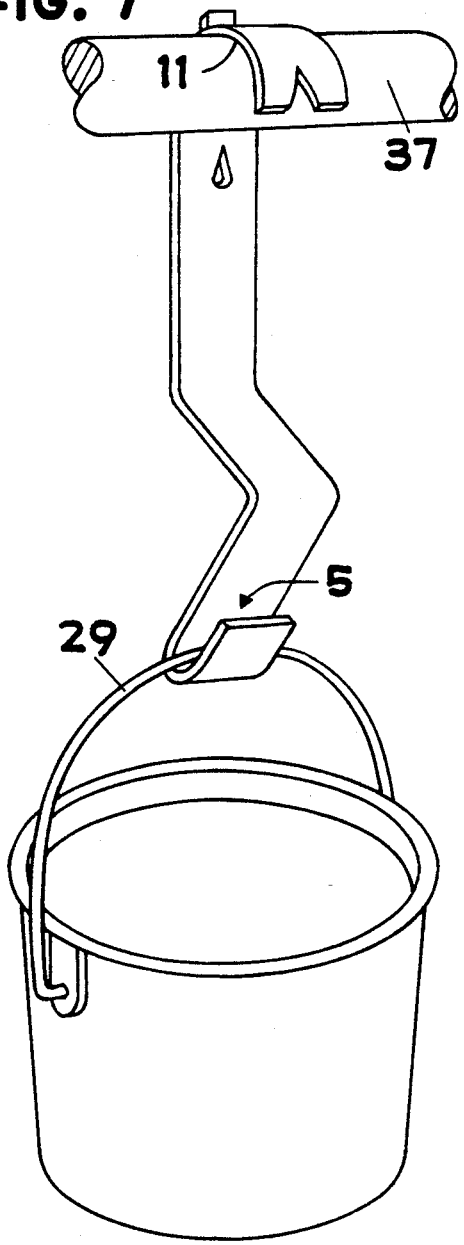
FIG. 7 is a perspective view of the terminal hook of the handle portion held-fast to the rung of a ladder, while the terminal extended hook of the body portion is receptive to the handle of a container.
Figure 8:
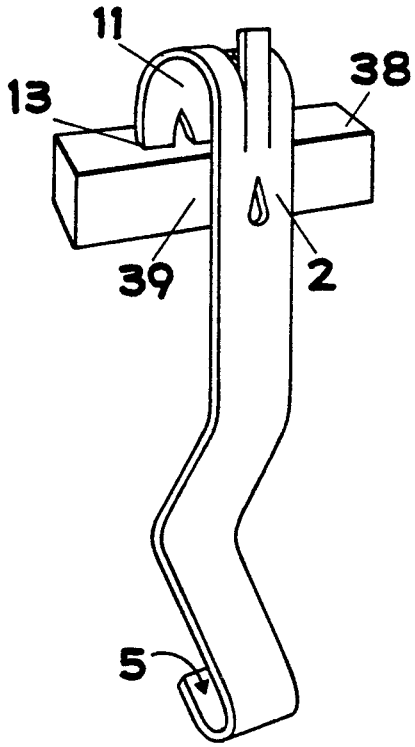
FIG. 8 is a perspective view of this invention held-fast to a narrow ledge.
Figure 9:
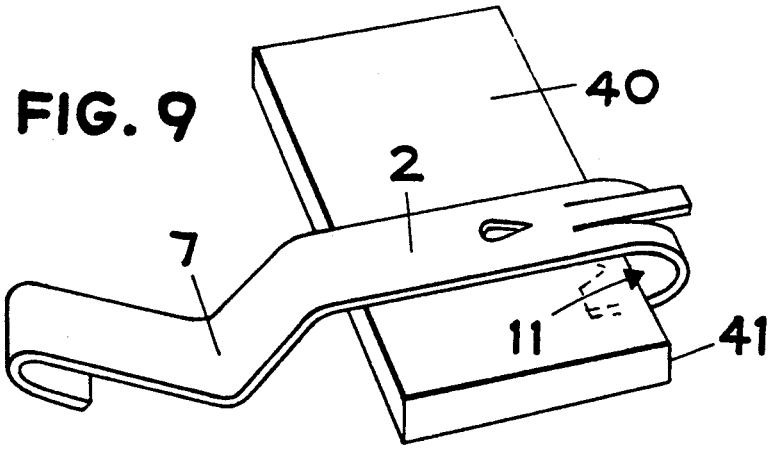
FIG. 9 is a perspective view of this invention held-fast to the top step of a step-ladder.

Said handle portion provided with a reverse bend 10 to form a terminal hook 11, preferably on the same side as said body portion's terminal extended hook 5, said terminal hook 11 formed to hold-fast from such supports as herein designated 37 in FIG. 7, 38 in FIG. 8 and 40 in FIG. 9 to stabilize the other appropriate hook, either 5 or 7. Said handle portion is also provided with dual nail extractor apertures, one preferably being adjacent the beginning of said reverse bend 10 as indicated at 12 and the other centrally located on the terminal edge 13 of said reverse bend 10, here-in designated 14 as illustrated in FIG. 2. Said handle portion further provided with a relatively straight oblong appendage 15, preferably incised centrally from the width of said reverse bend leaving an oblong appendage aperture 16 to curve with said reverse bend 10. Said appendage 15 originated from the beginning of said reverse bend 10 and projected forwardly on the same plane as said handle portion 2 as an extension and designed to remove metal lids from metal containers as indicated in FIG. 10. Said handle portion 2 provides for said hammer-head 5 to be a complete hammer to close lids tightly on containers.

Figure 6:
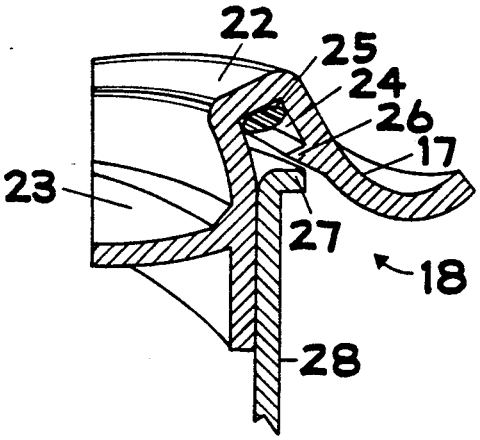
FIG. 6 is the sectional view of the coverture of FIGURE disengaged from the sealed position.

FIG. 3 shows the initial phase of a plastic lid removal performance from a plastic pail. The proper application is as follows:

Firstly, the plurality of apertures of the skirt 17 must be fissured through the bottom edge 30 of said skirt, visibly indicated at 31, 32 and 33 in FIGS. 3 and 4, to allow sectional portions of said skirt to facilitate disengaging the locking member 26 of the coverture 24 as indicated in FIG. 6 in a sequential manner from the rim 27 of the pail 28. The terminal extension 4 of the terminal extended hook 5 is then directed to said skirt 17 from underneath and is slidably inserted and ascended in the provided gap 18 to the allowable maximum, thus assuring said skirt 17 to be fully engaged as indicated in FIG. 3. The handle 2 portion is then forcefully pushed toward the opposite side of the lid while said skirt 17 engaged by the terminal extended hook 5 is being distortedly bent outwardly and simultaneously uplifted as the body 1 pivots on the rim 22 of the lid acting as a fulcrum for leverage and forcing the body portion's rear-end right angled bend 6 to meet or be contiguous to the main surface 23 of the lid, while said terminal extended hook 5 is elevated above the rim 27 of the pail 28, enacting the initial disengagement of said locking member 26 of said coverture 24 from said rim of the pail 28 as indicated in FIGS. 4 and 6. Repetition of this performance around the diameter of said skirt 17 removes the lid.

FIG. 7 shows the application of the terminal hook 11 employed with the terminal extended hook 5. Said terminal hook 11 being held-fast to a support for stability, in this case the rung 37 of a ladder, while the said terminal extended hook 5 is being receptive to the handle 29 of a container.

FIG. 8 shows the application of the terminal hook 11 with its terminal edge 13 vertically held-fast on the top of the horizontal support for stability, conveying in this instance a narrow horizontal ledge 38 with the oblique handle 2 portion positioned vertically against the outside edge 39 of said ledge 38. The terminal extended hook 5 being open for reception of a container handle.

FIG. 9 shows the application of the terminal hook 11 employed in combination with the hook 7. The hook 11 applied to the support for stability, which in this example is the flat horizontal top step 40 of a step-ladder, whereby said terminal hook 11 holds-fast to the edge 41 on one side of the width of said top step 40 as the handle 2 portion traverses and overhangs the width of said top step 40, exposing said hook 7 faced upward to receive the handle of a container.

FIG. 10 shows the application of the approach to the removal of a metal lid from a metal container with the combination tool. The rim 35 of the lid, spaced from the rim 36 of the container forms a gap 34 providing the necessary space for removal. The oblong appendage 15 of the tool is inserted in the gap 34 from above and the handle 2 portion is then forced downwardly in archlike fashion pivoting on said rim 36 of the container to pry the rim 35 of the lid upwardly. Repetition of this performance around the circumference of the rim 35 of the lid will remove it.

FIG. 11 shows the application of the terminal extended hook 5, as a hammer-head in conjunction with the handle 2 portion, positioned to perform as a complete hammer on the rim 35 of the lid, to close the lid tightly on the container. The tool performs best when used edgewise as indicated.

The application of the nail extractor apertures 12 and 14, as indicated in FIG. 2, offers a choice when considering space and leverage to remove unwanted nails prior to painting.

This completes the description of the combination tool of the present invention. It will be apparent that the combination tool of the present invention is of inherently attractive and decorative appearance.

It will be further apparent that numerous modifications and variations in the combination tool of the present invention may be made by anyone skilled in the art, in accordance with the principles of the invention hereinabove set forth, and without the use of any inventive ingenuity. I desire, therefore, to be protected for any and all such modifications and variations that may be made within the spirit of the invention and the scope of the claims hereto appended.

I claim:

1. A combination tool comprising lid removers, hooks, nail extractors and a hammer, formed from a one-piece elongated normally-flat rigid strip applied with bends, apertures and incisions thereon, providing two principle portions, namely, a relatively straight body portion connected by an extension to a relatively straight oblique handle portion on the other end in an extended direction from said body portion, the front end of said body portion formed with a reverse bend providing a relatively straight terminal extension proceeding in the same general direction from said reverse bend as said body portion but shorter in length and in conjunction with the adjacent said body portion forms a terminal extended hook furnished with integral means to engage the skirt of a plastic lid to facilitate removal of said lid from a plastic pail, also be receptive to the handle of a container thereon, and further to perform as a hammer-head, the rear-end of said body portion, formed with a right angled bend projected in the opposite direction of said body portion's terminal extended hook side and precedes an extension provided with a bend to said oblique handle portion, the concave side of said body portion's rear-end right angled bend, when faced upwardly provides a receptive hook for the handle of a container thereon, said oblique handle portion provided with a reverse bend to form a terminal hook on the same side as the said body portion's terminal extended hook, said terminal hook normally provides hold-fast means for the other individual hooks, said handle portion provided with a relatively straight oblong appendage incised centrally from the width of said reverse bend leaving an oblong appendage aperture to curve with said reverse bend, said oblong appendage originated from the beginning of said reverse bend and projected on the same plane as said handle portion as an extension to remove metal lids from containers, said handle portion is also provided with dual nail extractor apertures, one being adjacent the beginning of said reverse bend and the other centrally located on the terminal edge of said reverse bend, and further, said handle portion provides the means for said hammer-head to be a complete hammer.

* * * * *